United States Patent [19]

Iwasaki

[11] 4,358,761

[45] Nov. 9, 1982

[54] DOT MATRIX DISPLAY APPARATUS

[75] Inventor: Shoji Iwasaki, Tottori, Japan

[73] Assignees: Sanyo Electric Co. Ltd., Moriguchi; Tottori Sanyo Electric Co., Ltd., Totori, both of Japan

[21] Appl. No.: 189,586

[22] Filed: Sep. 23, 1980

[30] Foreign Application Priority Data

Sep. 28, 1979 [JP] Japan ..... 54/126070
Sep. 28, 1979 [JP] Japan ..... 54/126071
Sep. 28, 1979 [JP] Japan ..... 54/135565[U]

[51] Int. Cl.[3] ..... G09G 3/20
[52] U.S. Cl. ..... 340/792; 340/726
[58] Field of Search ..... 340/792, 723, 726

[56] References Cited

U.S. PATENT DOCUMENTS 3,976,995 8/1976 Sebestyen ..... 340/792 X
4,024,531 5/1977 Ashby ..... 340/792 X

*Primary Examiner*—David L. Trafton
*Attorney, Agent, or Firm*—Darby & Darby

[57] ABSTRACT

Character information to be displayed is stored in a temporary memory. Character data (ASCII code) is provided from the temporary memory to a character generator. The character generator is responsive to the character data to convert them into a dot display signal displaying each character in m columns and n rows. Then the display signal of each common row of the respective characters is transferred to a shift register in a bit serial fashion. Each time the display signal for one character is transferred a display blank signal is loaded in the shift register. A dot matrix display comprises rows of the same number as the cells of the shift register for producing a blank of one column between the adjacent characters, while displaying each character in m columns and n rows. After display is made on the display for all the rows, a leftward shift is made in succession one column by one column from the lowest row. When the shift amount comes to correspond to one character, new character information is loaded in the temporary memory.

38 Claims, 44 Drawing Figures

| | 0 1 2 3 | 4 5 6 7 | 8 9 |
|---|---|---|---|
| 0 | CNTA | CNTn | |
| 1 | CNTB | CNTi | |
| 2 | CNTC | CNTj | |
| 3 | | | |

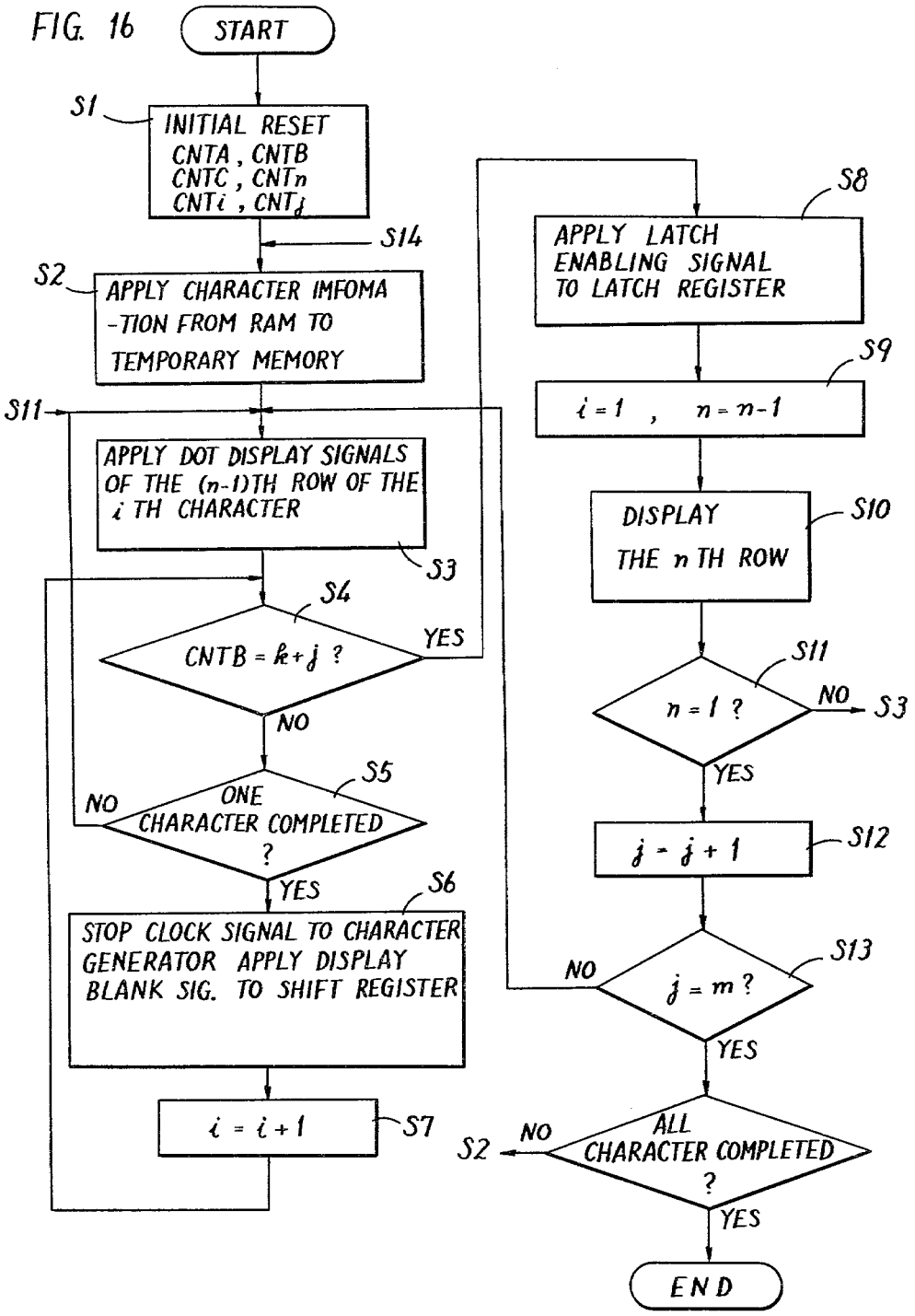
FIG. 16
START
S1
INITIAL RESET
CNTA, CNTB
CNTC, CNTn
CNTi, CNTj
S14
S2
APPLY CHARACTER IMFOMA
-TION FROM RAM TO
TEMPORARY MEMORY
S11
APPLY DOT DISPLAY SIGNALS
OF THE (n-1)TH ROW OF THE
i TH CHARACTER
S3
S4
CNTB = k+j ?
YES
NO
S5
ONE
CHARACTER COMPLETED
?
NO
YES
S6
STOP CLOCK SIGNAL TO CHARACTER
GENERATOR APPLY DISPLAY
BLANK SIG. TO SHIFT REGISTER
i = i+1
S7
S8
APPLY LATCH
ENABLING SIGNAL
TO LATCH REGISTER
S9
i = 1 , n = n-1
DISPLAY
THE n TH ROW
S10
S11
n = 1 ?
NO
S3
YES
j = j + 1
S12
S13
j = m ?
NO
YES
ALL
CHARACTER COMPLETED
?
NO
S2
YES
END

DOT MATRIX DISPLAY APPARATUS

BACKGROUND OF THE INVENTION

1. Field of the Invention

The present invention relates to a dot matrix display apparatus. More specifically, the present invention relates to a dot matrix display apparatus for displaying a limited number of characters, wherein the characters are displayed such that the display position of each character is successively shifted from the right to the left, for example.

2. Description of the Prior Art

FIG. 1 is a view showing one example of a dot matrix display for explaining the background of the invention. Conventionally, a dot matrix display has been used which displays each character using dots arranged in m columns and n rows, where m and n are natural numbers, such as "4×7", "5×7", "7×9" and so on. In such dot matrix display, a plurality of display units each including dots in m columns by n rows are provided, so that one character is allotted and is displayed to and by one display unit. In the case where a sentence including a plurality of characters is to be displayed, the characters being displayed are moved or shifted for each predetermined time period from the right to the left, for example, on a character-by-character basis. However, since such conventional moving or shifting display involves movement or shifting of characters on a character-by-character basis, it is very difficult for a viewer to read the displayed information.

On the other hand, an electric light signboard for displaying a series of words such as a sentence has also been well-known. In such an electric light signboard, the display region is not divided into characters but is rather used as a unitary region having dots in l columns and n rows, where $l>m$, and characters are displayed such that the displayed positions of the characters are moved from the right to the left, for example, on a column-by-column basis. Such display may be referred to as "a scroll display". Since a scroll display makes the characters appear to flow, it is very easy for a viewer to read the characters. However, a display such as a conventional electric light signboard involves a problem. More specifically, with such conventional electric light signboard, generally a paper tape punch to represent a display signal associated with the characters being displayed needs to be prepared. The information contained in such punched paper tape is subjected to an optical reader so that the information is converted into an electrical display signal and the electrical display signal is loaded in a shift register, whereupon the display is driven in accordance with the content in the shift register. However, such display using a punched paper tape and an optical reader suffers from a tiresome maintenance of an optical reader and tiresome punching of a paper tape to provide information being displayed. Furthermore, it is extremely difficult to utilize the same paper tape for display of a different sentence. A scroll display type dot matrix display apparatus having easily legible displayed characters and of simple structure and maintenance have not been so far available.

SUMMARY OF THE INVENTION

In brief, the present invention employs a dot matrix display for displaying a plurality (j) of characters each character being allotted a group of dots arranged in m columns by n rows. Character information being displayed is obtained from an input line connected to a keyboard, a random access memory, or the like. A display signal of m columns by n rows of the respective characters is generated in accordance with the obtained character information. The dot matrix display is controlled such that the columns are driven for display in accordance with the content in the register having storing regions of substantially the same number as that of the total column number of the display. The display signal of the common row as regards one character of the display signal is loaded in succession in the register in response to a clock signal. If and when the display signal for all the n rows is loaded in the register at least once, the column of the display signal to be loaded is shifted. If and when the column is shifted at least m times, then new character information to be displayed is obtained. According to the present invention, a scroll display type dot matrix display apparatus can be implemented using electronic components. Accordingly, any mechanical means such as a paper tape and an optical reader as required in a conventional electric light signboard can be dispensed with. Therefore, maintenance becomes very simple as compared with a conventional unit. In addition, since characters to be displayed can be readily changed by simply changing character information to be provided, manual work required for display becomes very simple as compared with a conventional unit using a paper tape and an optical reader.

In a preferred embodiment of the present invention, in the case where information is loaded in a register with the same shifted by one column, for example, for every n rows and the characters are scrolled from the right to the left on the display, the column is shifted successively from the lowermost row to the uppermost row and in the reverse case the column is shifted in the reverse direction. In a preferred embodiment of the present invention, the characters displayed on the display look as if they are inclined rightward like a script typeface, which is easily legible.

In a further preferred embodiment of the present invention, in loading the display signal of the common row in the register, a signal for a blank display is added between adjacent characters. Accordingly, the register is loaded with a column for blank display in addition to the above described m columns per each character. According to the preferred embodiment a column for a blank display can be provided with ease between the adjacent characters. In addition, since such a signal for a blank display can be added arbitrarily, a blank display is not restricted by the number of characters to be displayed, the display positions and the like. Accordingly, such is extremely effective in the case of a scroll display.

Accordingly, a principal object of the present invention is to provide a scroll display type not matrix display apparatus which does not require any mechanical means as conventionally required.

Another object of the present invention is to provide a scroll display type dot matrix display apparatus, wherein characters being displayed can be changed with ease.

A further object of the present invention is to provide a scroll display type dot matrix display apparatus which is easily legible.

Still a further object of the present invention is to provide a scroll display type dot matrix display apparatus, wherein a blank display can be added with ease between the adjacent characters.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 16 is a flow diagram for explaining the operation of the FIG. 14 embodiment.

DESCRIPTION OF THE PREFERRED EMBODIMENTS

Figure 2:
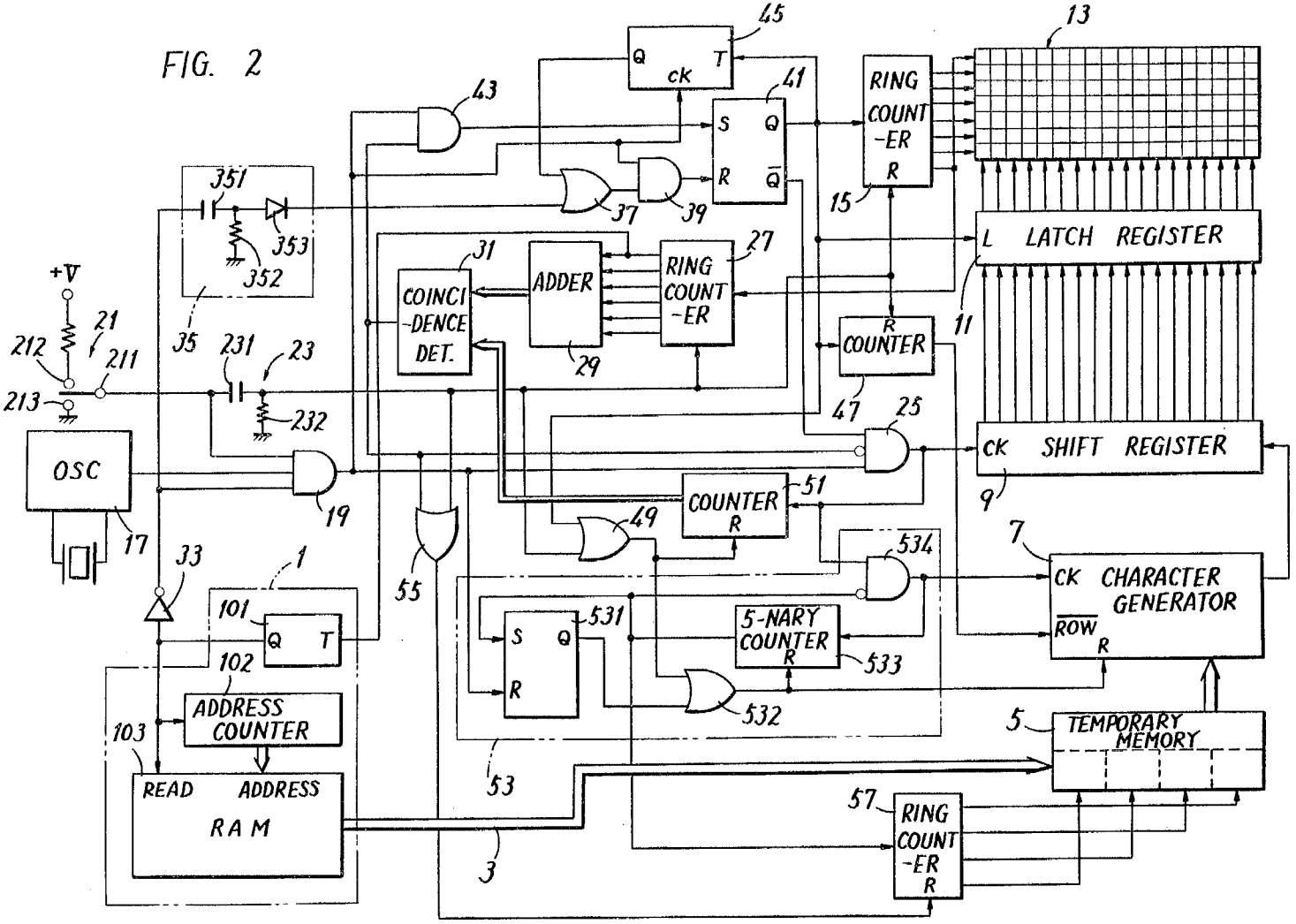
FIG. 2 is a block diagram showing one embodiment of the present invention.

FIG. 2 is a block diagram showing one embodiment of the present invention. The embodiment shown is an example which is structured using discrete circuit components; however, the circuit may be implemented using a microprocessor or microcomputer, programmed to perform the desired operation.

The FIG. 2 embodiment comprises a memory circuit 1 serving as a means for supplying character information. The memory circuit 1 need not be incorporated to be operatively coupled to a display but alternatively may be a memory, such as a random access memory, a read only memory or the like, in a computer (not shown) or may be implemented using a magnetic memory, such as a magnetic disk, a magentic tape or the like. Furthermore, the circuit 1 may be replaced by a well-known keyboard serving as a means for supplying character information. In any case, a data bus 3 of parallel 6 bits, for example, constituting a portion of the means for supplying character information, runs from the circuit 1 to a temporary memory 5. Accordingly, character information is provided from the circuit 1 through the data bus 3 to the temporary memory 5. The temporary memory 5 comprises storing regions of four characters, for example. Character data of such as the ASCII code is provided from the temporary memory 5 to a character generator 7. Accordingly, the temporary memory 5 comprises a means for converting the given character information into character data in, e.g., ASCII code. The character generator 7 may be a character generator, TMM334P manufactured by Toshiba Corp. or MM5240 manufactured by National Semiconductor Corp., for example. The character generator 7 is responsive to the given character data to provide to a shift register 9 logical pattern information including a combination of the logics one and zero in association with the respective dot information in five columns by seven rows, for example, in a bit serial fashion. The shift register 9 comprises storing cells of the same number as the total column number of the dot matrix display 13, so that a display signal for one row of the display 13 may be stored. The output of the shift register 9 is provided to a latch register 11 in a bit serial fashion. The latch register 11 comprises a column driver circuit, so that the corresponding columns of the dot matrix display 13 are driven to be diaplayed or are not driven to be displayed responsive to the stored logic one or zero. The dot matrix display 13 comprises an arrangement of dots in eighteen columns by seven rows so as to be capable of displaying three characters, for example, and the rows of the display 13 are sequentially scanned to be driven by means of a ring counter 15 including row drivers.

The above described dot matrix display 13 is structured to be capable of displaying a plurality (j) of characters by using an arrangement of dots in a plurality (m) of columns by a plurality (n) of rows for each character on the dot matrix display 13. Accordingly, the above described number j is selected to be $j=1+k/m$ (where k is a natural number). More specifically, the display 13 need not necessarily be structured to display an integral number of characters. Accordingly, the number of characters that can be displayed may be selected such that $j=3\ 1/5$, $5\ 2/5$, or the like. Furthermore, the above described temporary memory 5 is structured to be capable of temporarily storing a plurality (i) of pieces of character information, wherein the number i is a natural number and is selected so that $i>j$. As briefly described previously, the embodiment shown is structured such that a display signal is obtained from the character generator 7 in association with the character information obtained from the memory circuit 1 and the respective columns of the dot matrix display 13 are selectively driven in response to the display signal.

The embodiment shown comprises a reference oscillator 17 for the purpose of fundamental synchronization of the circuit. The reference oscillator 17 may comprise a crystal controlled oscillator and the output thereof is applied to one input of a three inputted AND gate 19. Another input of the three inputted AND gate 19 is connected to receive the output of a switch 21. The switch 21 comprises a movable contact 211 and two fixed contacts 212 and 213. The fixed contact 212 is connected through a given resistor to a source voltage (+V) and the other fixed contact 213 is connected to ground. Accordingly, by turning the movable contact 211 of the switch 21 from the fixed contact 213 to the fixed contact 212, a signal of the high level is obtained from the contact 211. The output of the switch 211 is further applied to a one-shot circuit 23. The one-shot circuit 23 comprises a capacitor 231 and a resistor 232 and the output thereof is applied to the respective circuits as an initial resetting signal. The remaining input of the three inputted AND gate 19 is connected to receive the output of an inverter 33, to be described subsequently, and the output of the AND gate 19 is applied to one input of a three inputted AND gate 25 and to one input of a two inputted AND gate 43 and is further applied to a reset input (R) of a flip-flop 531 included in a display blank signal generating circuit 53. Another input of the three inputted AND gate 25 is connected to receive an inversion of the output from a coincidence detecting circuit 31, to be described subsequently, and the output ($\overline{Q}$) of a flip-flop 41, to be described subsequently. Accordingly, a clock signal obtained from the reference oscillator 17 is controlled by means of the AND gates 19 and 25.

The row driver, i.e. the ring counter 15 comprises seven output lines corresponding to the number of rows (n=7) of the dot matrix display 13. The first output line among these seven output lines serves as a drive line of the second row of the dot matrix display 13 and the second output line corresponds to the third row of the display 13, the third output line corresponds to the fourth row, the fourth output line correspond to the fifth row, the fifth output line corresponds to the sixth row, the sixth output line corresponds to the seventh row, and the seventh output line corresponds to the first row. This relationship between the output lines and the rows of the display 13 is one of the features of the embodiment shown, as to be more fully described subsequently. The seventh output line of the ring counter 15 is further connected to the input of a ring counter 27. The ring counter 27 is adapted to receive the input each time the ring counter 15 makes one circulation, thereby to renew in succession the output thereof for each new entry of the input. The first to sixth outputs of the ring counter 27 are applied to an adder 29. The first output of the ring counter 27 is applied to a one-shot circuit 101 included in the memory circuit 1. The one-shot circuit 101 is triggered responsive to a positive edge of the first output of the ring counter 27. The adder 29 receiving the output of the ring counter 27 is responsive to the output of the ring counter 27 to evaluate which column's display signal is to be applied from the character generator 7 to the shift register 9 at that time. Therefore, although not shown, the adder 29 comprises a constant generator such as a read only memory, so that the numeral value "17" may be provided from the constant generator. Accordingly, the adder 29 makes addition of the output of the ring counter 27 and the above described numerical value "17" and the sum output from the adder is applied to one input of the coincidence detecting circuit 31. The other input of the coincidence detecting circuit 31 is connected to receive the count value of a counter 51, to be described subsequently. Accordingly, a leftward shifting operation on a column-by-column basis is controlled by means of the ring counter 27, the adder 29 and the coincidence detecting circuit 31.

The one-shot circuit 101 included in the above described memory circuit 1 provides a high level output for a predetermined time period when the first output of the ring counter 27 rises to the high level. The output of the one-shot circuit 101 is applied to the above described inverter 33 and is also applied to an address counter 102 and a random access memory 103 as a read enable signal (READ). Accordingly, each time one pulse is obtained from the one-shot circuit 101, the address counter 102 renews the address of the random access memory, so that character information is read from the random access memory responsive to the output of the one-shot circuit 101. The output of the above described inverter 33 is applied to one input of the previously described AND gate 19 and is also applied to a one-shot circuit 35. The one-shot circuit 35 comprises a capacitor 351, a resistor 352 and a diode 353. After the new character information is transferred from the memory circuit 1 to the temporary memory 5, the one-shot circuit 35 generates a signal for enabling the loading of the first display signal in the shift register 9. The output of the one-shot circuit 35 is applied to one input of the OR gate 37. The other input of the OR gate 37 is connected to receive the output of a binary counter 45, to be described subsequently, and the output of the OR gate 37 is applied to one input of a two inputted AND gate 39. The other input of the two inputted AND gate 39 is connected to receive the output from the AND gate 19, i.e. the clock signal. The clock signal is further applied to the binary counter 45 as a clock and is also applied to one input of a two inputted AND gate 43. The other input of the two inputted AND gate 43 is connected to receive the output of the previously described coincedence detecting circuit 31 and the output of the AND gate 43 is applied to the set input (S) of a flip-flop 41. The reset input (R) of the flip-flop 41 is connected to receive the output of the previously described AND gate 39. The non-inverted output (Q) of the flip-flop 41 is applied to the ring counter 15 and is also applied to the above described binary counter 45 as a trigger input and is also applied to a latch register 11 as a latch enabling signal (L). Accordingly, the AND gate 43, the flipflop 41 and the binary counter 45 cooperate with each other to generate an enabling signal for loading the data in the latch register 11.

The non-inverted output (Q) of the flip-flop 41 is further applied to the counter 47 as a count input and is also applied to one input of the OR gate 49. The counter 47 serves as a counter for representing which row is being presently displayed and the output of the counter 47 is applied to the character generator 7 as a row designating signal ($\overline{ROW}$). The output of the above described three inputted AND gate 25 serves as a clock signal and the same is applied to the clock input (CK) of the shift register 9 and is also applied to the count input of the counter 51. The clock signal obtained from the AND gate 25 is applied to one input of a two inputted AND gate 534 included in a display blank signal generating circuit 53. The display blank signal generating circuit 53 serves as a circuit for providing a one column display blank signal for each character in transferring the display signal from the character generator 7 to the shift register 9. The circuit 53 comprises a reset preferential flip-flop 531. The reset input (R) of the flip-flop 531 is connected to receive the output of the three inputted AND gate 19 and the set input (S) of the flip-flop 531 is connected to receive the output of a counter 533 included in the circuit 53. The counter 533 serves to determine whether the one character display signal has transferred from the character generator 7 to the shift register 9 and the output thereof is applied to the flip-flop 531 and is also applied to the count input of the ring counter 57. More specifically, the counter 533 provides the output, each time the one character display signal, i.e. the display signal of 5 bits is transferred from the character generator 7 to the shift register 9. The output of the counter 533 is inverted and is applied to the other input of the above described two inputted AND gate 534. The ring counter 57 serves to designate the storing regions of the temporary memory 5.

The output of the above described one-shot circuit 23 is applied to the reset inputs (R) of the above described ring counters 15 and 27 and the counter 47. At the same time, the output of the one-shot circuit 23 is applied to the other input of the OR gate 49. The output of the OR gate 49 is applied to the reset input (R) of the counter 51 and is also applied to one input of the OR gate 532 included in the circuit 53. The other input of the OR gate 532 is connected to receive the non-inverted output (Q) of the flip-flop 531 and the output of the OR gate 532 is applied to the reset inputs (R) of the counter 533 and the character generator 7. The output of the one-shot circuit 23 and the output of the coincidence detecting circuit 31 are applied to the inputs of the OR gate 55 and the output of the OR gate 55 is applied to the reset input (R) of the ring counter 57.

The embodiment shown employs light emitting diodes of a shorter afterglow time in the dot matrix display 13 in the arrangement of eighteen columns by seven rows, totaling 126 dots constituting a dot matrix display. If a high voltage is available from the display driver, such a dot matrix display 13 may be implemented by a scan type plasma display.

Now that the structural features of the embodiment shown have been described, operation of the FIG. 2 embodiment will be described with reference to FIGS. 3 to 6. At beginning of the operation, the temporary memory 5 stores the alphabet characters "A", "B", "C" in the second to fourth storing regions thereof and a given character in the first storing region. Thereafter the alphabet character "D" is transferred to the temporary memory 5. Accordingly, it follows that the temporary memory 5 stores the alphabet characters "A", "B", "C" and "D" in the first to fourth storing regions thereof, respectively. In the following a description will be made of the operation in which the alphabet characters "A", "B", "C" and "D" are displayed in a scrolling manner from the right to the left of the display using the dot matrix display 13. In operation, the movable contact 211 of the switch 421 is first turned to the fixed contact 212. Then the high level output is obtained from the switch 21. Accordingly, the one-shot circuit 23 provides the high level signal for a predetermined time period after the output of the switch 21 turns to the high level. Accordingly, the respective counters 15, 27, 47, 51, 533 and 57 and the character generator 7 are all reset to an initial condition. Therefore, the ring counters 15, 27 and 57 provide the outputs from the first output lines, respectively. The switch 21 provides the high level continually thereafter, unless the contact 211 is turned to the contact 213. However, the output of the one-shot circuit 23 falls to the low level again after the above described predetermined time period. The positive edge triggered one-shot circuit 101 is responsive to the first output line of the ring counter 17 turning to the high level to provide the high level signal for a time period necessary for reading the character information of one character from the random access memory 103. Accordingly, the address counter 102 designates a desired address of the random access memory and the random access memory 103 is supplied with a read enable signal (R). Therefore, character information representing the character "D" is transferred from the random access memory 103 through the data bus 3 to the fourth storing region of the temporary memory 5. At that time the output of the inverter 33 is the low level and accordingly one input of the AND gate 19 is the low level. Accordingly, during the output period of the one-shot circuit 101 the clock signal is blocked from being obtained from the AND gate 19. Thereafter, the output of the one-shot circuit 101 becomes the low level and the output of the inverter 33 rises to the high level. Accodingly, the high level pulse is obtained from the one-shot circuit 35. At that time, when the clock signal is obtained from the reference oscillator 17, the output of the two inputted output 39 is responsive to the clock signal to become the high level. Accordingly, the flip-flop 41 is reset and the inverted output ($\overline{Q}$) thereof becomes the high level. Accordingly, the clock signal being obtained as the output of the three inputted AND gate 19 is obtained from the three inputted AND gate 25. At that time, the character generator 7 is provided with the character data of the ASCII code. Accordingly, the character generator 7 is responsive to the given ASCII code to generate the display signal of the character "A" in m columns by n rows. More specifically, the character generator 7 provides the display signal corresponding to the character "A", which comprises the dot display signals of "01110", "10001", "10001", "11111", "10001", "10001" and "10001" in succession from the first to seventh rows. Likewise, the display signal of the character "B" comprises the dot display signals of "11110", "10001", "10001", "11100", "10001", "10001" and "11110" in succession from the first to seventh rows. The display signal of the character "C" comprises the dot display signals of "01110", "10001", "10000", "10000", "10000", "10001" and "01110". The display signal of the character "D" comprises the dot display signals of "11100", "10010", "10001", "10001", "10001", "10010" and "11100". Meanwhile, the data of one row which is designated by the input ($\overline{ROW}$) to the counter 47 is outputted from the character generator in row sequence.

Responsive to the first clock from the AND gate 25, transfer of the display signals from the character generator 7 to the shift register 9 is initiated. At that time, the counter 47 has designated the seventh row of the character generator 7. Accordingly, responsive to the five clocks from the AND gate 25, the dot display signal of the seventh row of the character "A", i.e. the dot display signal of "10001" is transferred from the character generator 7 to the shift register 9.

When the dot display signal "10001" of the seventh row of the character "A" is transferred from the character generator 7, both the counters 51 and 533 have stored the count values of "5". Accordingly, as the output of the counter 533 becomes the high level, one input of the AND gate 534 becomes the low level and the flip-flop 531 is set. The ring counter 57 is also counted up and the output is obtained from the second output line of the counter 57. When the flip-flop 531 is set, the non-inverted output (Q) becomes the high level and the counter 533 is reset and the character generator 7 is reset. Thereafter the 6th clock signal is obtained from the AND gate 25. However, since one input of the AND gate 53 has become the low level, the AND gate 534 does not provide the clock signal from the output thereof. Accordingly, the 6th clock signal is applied only to the shift register 9 and the counter 57. Therefore, although the shift register 9 is shifted leftward by one bit, the input signal thereof at that time is the logic zero. Thus, after the transfer of the seventh row dot display signal of the first character "A", the display blank signal of one bit (corresponding to one column) is applied to the shift register 9.

Thereafter the output of the counter 533 becomes the low level and, responsive to the following five clock signals, the dot display signal "11110" of the seventh row of the character "B" is transferred from the character generator 7 to the shift register 9. Again the one bit display blank signal is added following the seventh row dot display signal of the character "B" by means of the counter 533 and the AND gate 534. Then the seventh row dot display signal "01110" of the character "C" and the following display blank signal are loaded in the shift register 9.

Thus the dot display signals of the common row, i.e. the seventh row dot signals of the characters "A", "B", and "C" are loaded in the shift register 9. Then at that time the count value in the counter 51 has become the numerical value "18". On the other hand, the numerical value 1 is applied to the addition input of the constant adder 29 from the ring counter 27 and the addend of the adder 29 is the numerical value "17", as described previously. Accordingly, the output of the adder 29 is also the numerical value "18". Therefore, the output of the coincidence detecting circuit 31 becomes the high level at that time. Thereafter, when the 19th clock signal is obtained from the AND gate 19, the AND gate 43 is responsive to the clock signal to provide the high level output. Accordingly, the non-inverted output (Q) of the flip-flop 41 turns to the high level. Accordingly, the ring counter 15 is counted up to provide the output from the sixth output line. At the same time, the binary counter 45 is triggered and the counter 47 is counted up. At the same time, the non-inverted output of the flip-flop 41 is applied to the latch register 11 as a latch enabling signal (L). Accordingly, the data is transferred from the shift register 9 to the latch register 11 responsive to the 19th clock signal. Accordingly, no display is made by the display 13 at that time.

Figure 1:
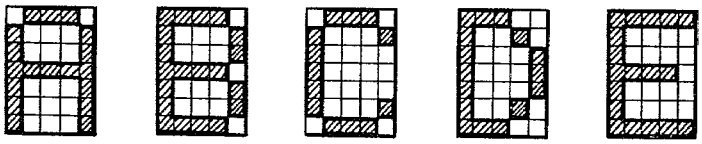
FIG. 1 is a view showing one example of a dot matrix display which is the background of the present invention.
Figure 3A:
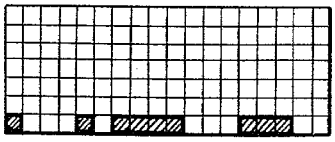
FIGS. 3A to 3G are views for explaining the operation of the FIG. 2 embodiment, and particularly showing how the dot matrix display is display controlled in row sequence.
Figure 3B:
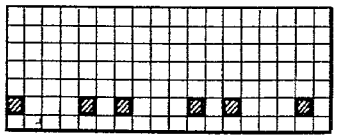

When the 20th clock signal is obtained from the AND gate 19, the binary counter 45 is counted up and the output (Q) thereof becomes the high level and the flip-flop 41 is reset. Accordingly, the non-inverted output ($\overline{Q}$) of the flip-flop 41 again becomes the high level and the AND gate 25 is again enabled. At that time, the ring counter 57 has been reset responsive to the high level output of the coincidence detecting circuit 31 and the ring counter 57 provides the output from the first output line. When the output is obtained from the sixth output line of the ring counter 15, the seventh row of the dot matrix display 13 is selectively driven. At that time, the seventh row dot display signals have been latched in the latch register 11. Therefore, when the 20th clock signal is obtained, only the dots corresponding to the logic one of the seventh row dot displaying signals are selectively driven to be displayed, as shown in FIG. 3A. On the other hand, transfer of the display signals from the character generator 7 to the shift register 9 is again initiated responsive to the 20th clock signal. Since the counter 47 has been counted up responsive to the high level of the non-inverted output (Q) of the flip-flop 41 at that time, the sixth row has been designated in the character generator 7. Therefore, the sixth row dot display signals of the characters "A", "B" and "C", i.e. the dot display signals of "10001", "10001" and "10001 " are transferred from the character generator 7 to the shift register 9 responsive to the 20th and following clock signals. Meanwhile, at that time the display blank signal of one bit (corresponding to one column), i.e. the logic zero is applied between the respective characters by means of the counter 533 and the AND gate 534, as previously described. When the 18th clock signals are obtained from the AND gate 25 thereafter, transfer of the sixth row dot display signals to the shift register 9 is completed. Accordingly, the count value in the counter 51 becomes the numerical value "18" and again the coincidence detected output of the high level is obtained from the coincidence detecting circuit 31. Accordingly, the high level output is obtained from the AND gate 43 responsive to the 39th clock signal and accordingly the flip-flop 41 is again set. Accordingly, non-inverted output (Q) of the flip-flop 41 is responsive to the 39th clock signal to become the high level and the ring counter 15 is counted up, so that the sixth row of the dot matrix display 13 corresponding to the fifth output line is selected by the ring counter 15. At the same time, the binary counter 45 is triggered and the counter 47 is counted up, whereby the counters 51 and 533 and the character generator 7 are reset. The ring counter 57 has been reset responsive to the high level output of the coincidence detecting circuit 31. When the latch enabling signal (L) is applied to the latch register 11 from the flip-flop 41, the sixth row dot signals which have been loaded in the shift register 9 are transferred to the latch register 11. When the 40th clock signal is obtained from the AND gate 19, the flip-flop 41 is reset and the non-inverted output ($\overline{Q}$) thereof again becomes the high level and the AND gate 25 is enabled. Accordingly, as shown in FIG. 3B, the displayed state of the dot matrix display 13 is such that the dots of the logic one in the sixth row dot displaying signals are selectively driven to be displayed.

Figure 3C:
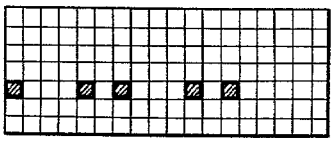

Responsive to the 40th clock signal, the display signal is transferred again from the character generator 7 to the shift register 9. Since at that time the counter 47 has been previously counted up, the fifth row is designated in the character generator 7. Thereafter, in the same manner as previously described, the fifth row dot display signals of the characters "A", "B" and "C", i.e. the dot display signals of "10001 ", "10001" and "10000" and the display blank signal are loaded in the shift register 9. When the 59th clock signal obtained from the AND gate 19 thereafter, the flip-flop 41 is set. Accordingly, the fifth row display signal of the shift register 9 is loaded in the latch register 11. At that time, the ring counter 15 has been counted up to select the fifth row of the dot matrix display corresponding to the fourth line output of the ring counter 15. Accordingly, when the 60th clock signal is applied, the dot matrix display 17 is driven such that the dots of the logic one in the fifth row dot display signals are selectively driven to be displayed, as shown in FIG. 3C.

Figure 3D:
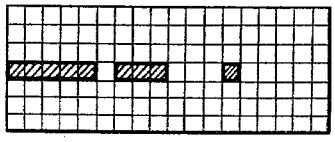
Figure 3E:
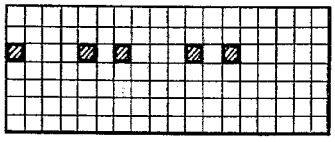
Figure 3F:
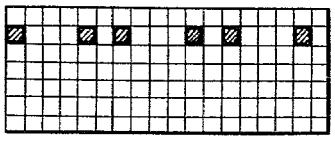
Figure 3G:
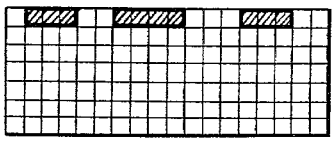
Figure 4:
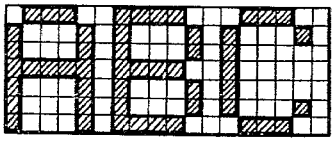
FIG. 4 is a view showing a displayed state observed by a viewer when the above described display operation shown in FIGS. 3A to 3G is completed.

While the fifth row of the dot matrix display 15 has been displayed as described previously, the fourth row dot display signals of the characters "A", "B" and "C", i.e. the dot display signals of "11111", "11100" and "10000" and the display blank signal are loaded from the character generator 7 to the shift register 9. Accordingly, when the 80th clock signal is obtained from the AND gate 19, the dot matrix display 13 is driven such that the dots of the logic one in the fourth row dot display signals are selectively driven to be displayed, as shown in FIG. 3D. Thereafter in the same manner, when the 100th clock signal is obtained, the dot matrix display 13 is driven so that the relevant dots in the third row are driven to be displayed, as shown in FIG. 3E. When the 120th clock signal is obtained, the display 13 is driven such that the relevant dots in the second row are displayed, as shown in FIG. 3F. When the 140th clock signal is obtained, then the display 13 is driven such that the relevant dots in the first row are displayed, as shown in FIG. 3G. Thus, the dots in the seventh row as shown in FIG. 3A to the dots in the first row as shown in FIG. 3G are driven to be successively displayed. Since the change from the FIG. 3A state to the FIG. 3G state is very fast, approximately 20 to 45 m sec, a series of characters "A", "B" and "C" appears to a viewer to be displayed as shown in FIG. 4. Meanwhile, alternatively the embodiment may be adapted such that only the data transfer is made from the character generator 7 to the shift register 9 at the beginning and the subsequent display time is controlled by a timer, not shown, so that the data is maintained for a given time period. In such a case, the time period required for data transfer may be approximately 0.2$\mu$ sec for each row.

Figure 5A:
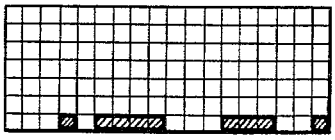
FIGS. 5A to 5G are views for explaining the operation of the above described embodiment, and particularly showing how the display is shifted leftward on a column-by-column basis in succession from the lowermost row of the display.
Figure 5B:
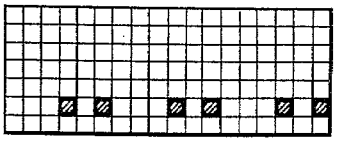
Figure 5C:
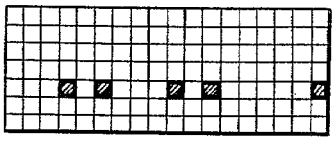
Figure 5D:
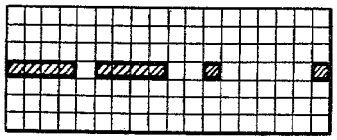
Figure 5E:
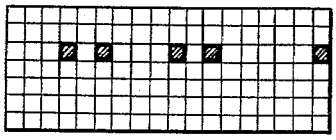
Figure 5F:
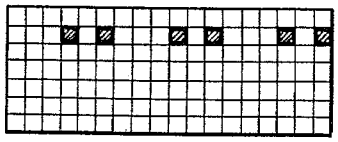
Figure 5G:
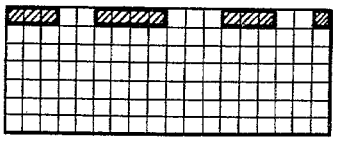
Figure 6:
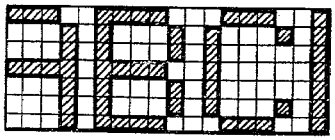
FIG. 6 is a view showing a displayed state after shifted leftward by one column observed by a viewer, when the shifting operation shown in FIGS. 5A to 5G is completed.

When the display shown in FIG. 3G is made, the output of the ring counter 15 is from the seventh output line and accordingly the ring counter 27 is counted up. Therefore, the numerical value "2" is applied from the ring counter 27 to the adder 29. As described previously, the adder 29 produces the constant value "17" determined in the read only memory, for example. Accordingly, at that time the output of the adder 29 becomes the numerical value "19". On the other hand, after the 140th clock signal is obtained from the AND gates 25 and 534, transfer of the seventh row dot display signals of the characters "A", "B" and "C" from the character generator 7 is initiated. It is when the 158th clock signal (commensurate with "19" counted by the counter 51) is obtained from the AND gate 19 that the clock signal from the AND gates 25 and 534 is stopped. The reason is that the numerical value from the adder 29 to the coincidence detecting circuit 31 has become "19". Accordingly, 19 clock signals in total are applied to the shift register 9. More specifically, the seventh row dot display signal of only one bit of the character "D" as well as the seventh row dot display signals of the characters "A", "B" and "C" are loaded from the character generator 7 to the shift register 9. On the other hand, the leading dot display signal of the character "A", i.e. the dot display signal of the logic one is shifted out from the shift register. Accordingly, at that time the shift register 9 has stored the 4-bit dot display signals of the character "A", the display blank signal, the 5-bit dot display signal of the character "B", the display blank signal, the 5-bit dot display signal of the character "C", the display blank signal and the 1-bit dot display signal of the character "D". More specifically, as a result of the second transfer of the seventh row dot display signals, the data has been leftward shifted by one column. Accordingly, when the 161th clock signal is obtained from the AND gate 19, the dot matrix display 13 is driven such that the dot pattern as shifted leftward by one column as compared with the FIG. 3A display is displayed, as shown in FIG. 5A. Likewise thereafter, when the 182th clock signal is obtained from the AND gate 19, the displayed state by the dot matrix display 13 becomes as shown in FIG. 5A. Likewise thereafter, each time the 21 (20+j) clock signals are obtained from the AND gate 19, the displayed state by the dot matrix display 13 becomes as shown in FIGS. 5C, 5D, 5E, 5F and 5G. Thus, at the time when the displayed state as shown in FIGS. 5A to 5G is completed, i.e. when the 287th clock is obtained from the AND gate 19, the display by the dot matrix display 13 is observed by a viewer, as shown in FIG. 6, in which the displayed state has been shifted leftward by one column as compared with the displayed state in FIG. 4. Likewise thereafter, each time a series of row scanning is effected from the seventh row to the first row, the displayed state is leftward shifted by one column and, as shown in FIGS. 7A to 7E, the displayed state is shifted by one character ultimately. Therefore, in the FIG. 7E state, the character "A" is not displayed any more on the dot matrix display 13.

Figure 7A:
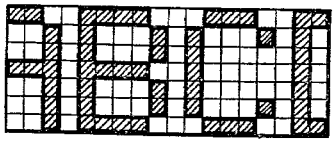
FIGS. 7A to 7E are views showing how the displayed character is shifted leftward by one character amount, i.e. by five columns, following the displayed state shown in FIG. 6.
Figure 7B:
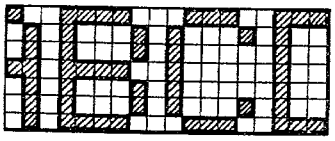
Figure 7C:
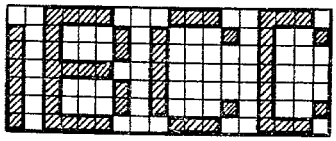
Figure 7D:
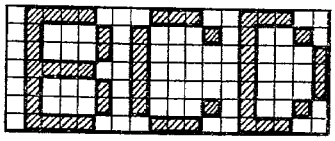
Figure 7E:
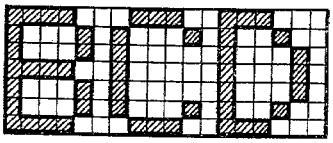
Figure 9A:
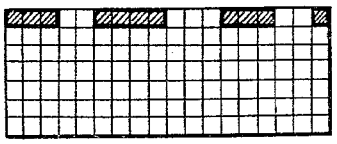
FIGS. 9A to 9G are views showing a displayed state when the display is shifted on a column-by-column basis from the uppermost row of the display.
Figure 9B:
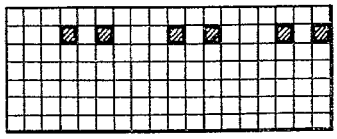
Figure 9C:
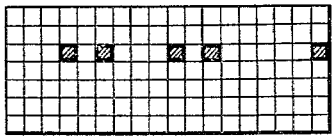
Figure 9D:
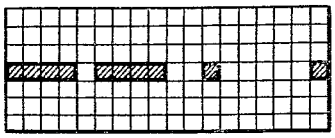
Figure 9E:
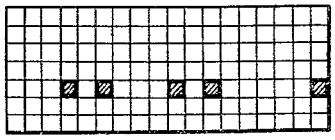
Figure 9F:
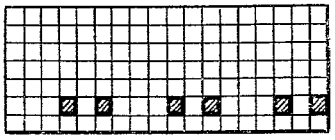
Figure 9G:
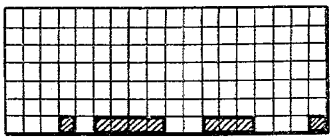
Figure 11A:
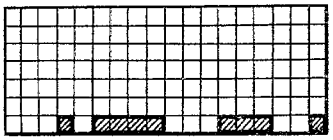
FIGS. 11A to 11G are views showing how the dot data is shifted leftward on a column-by-column basis in accordance with the so-called interlace scanning.
Figure 11B:
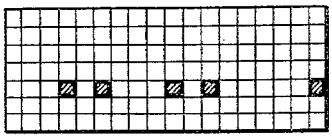
Figure 11C:
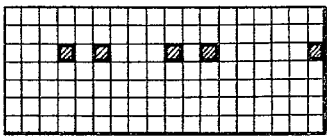
Figure 11D:
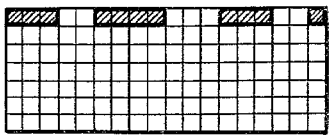
Figure 11E:
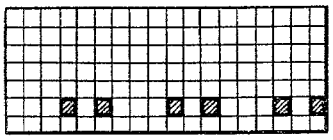
Figure 11F:
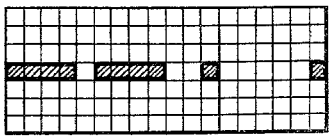
Figure 11G:
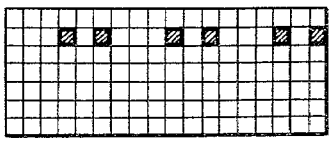

Immediately before the display shown in FIG. 7E, the ring counter 15 provides the output from the seventh output line. Accordingly, the ring counter 27 provides again the output from the first output line. Accordingly, the one-shot circuit 101 included in the memory circuit 1 is triggered and for a predetermined time period thereafter the high level pulse is obtained therefrom. Accordingly, during the high level output of the one-shot circuit 101, the dot matrix display 13 is prevented from being driven to be displayed by means of the inverter 22. At the same time the address counter 102 is counted up responsive to the pulse signal obtained from the one-shot circuit 101 and the read enable signal (READ) is applied to the random access memory 103. Accordingly, then the character information of the character "E" in the following address is read out from the random access memory 103 and the character information is stored through the data bus 3 in the fourth storing region of the temporary memory 5. Therefore, thereafter the characters "B", "C" and "D" and "E" are displayed in a scrolling manner by the dot matrix display 13. Thus, each time the dots in m columns (five columns in the embodiment) are leftward shifted on the display 13, the character information of the character being newly displayed is stored in the temporary memory 5.

Figure 8:
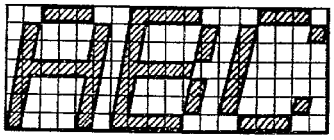
FIG. 8 is a view showing how the displayed character is in actuality observed by a viewer.

As described previously, one feature of the above described embodiment is that the seventh output of the ring counter 15 is utilized as the first row driving signal of the dot matrix display 13 and the seventh row of the display 13 is driven responsive to the sixth output of the ring counter 15. As a result, the ring counter 15 is reset in the initial condition, when the first output has been provided. When the non-inverted output (Q) of the flip-flop 41 has become the high level to make the next display, the ring counter 15 provides the output from the sixth output line. Accordingly, it follows that the dot matrix display 13 is controlled such that the rows are successively selected from the lowermost row, i.e. the seventh row. Therefore, when the display signal being loaded from the character generator 7 to the shift register 9 is shifted leftward on a column-by-column basis by means of the counter 51 and the adder 29 and the coincidence detecting circuit 31, the rows are shifted leftward in succession starting from the lowermost row of the display 13. This is extremely advantageous to a viewer. More specifically, when the characters are displayed to be moved from the right to the left on the display 13, as the rows are shifted leftward in succession starting from the lowermost row, then the characters being displayed on the display 13 look to a viewer as if they were inclined rightward as shown in FIG. 8. Such rightwardly oblique characters as are shown in FIG. 8 generally resemble script type faces, and accordingly the displayed characters are more legible.

Figure 10:
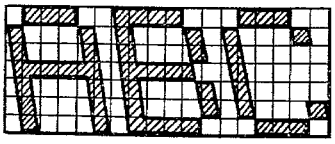
FIG. 10 is a view showing a displayed state which is actually observed by an operator on the display when the shifted leftward is made as shown in FIGS. 9A to 9G.

However, it is not necessarily required to make the leftward shifting from the lowermost and the display may alternatively be made as shown in FIGS. 9A to 9G and 10. More specifically, FIGS. 9A to 9G correspond to FIGS. 5A to 5G; however, whereas the display shown in FIGS. 5A to 5G is attained by the leftward shifting in succession from the lowermost row on the display 13, the display shown in FIGS. 9A to 9G is attained by the leftward shifting starting on from the uppermost row. As a result of the display shown in FIGS. 9A to 9G, the displayed characters appear to be leftwardly oblique, as shown in FIG. 10. Accordingly, if a display as shown in FIG. 8 is not preferred, alternatively a display as shown in FIG. 10 can be attained as desired.

FIGS. 11A to 11G are views showing a further different example of the leftward shifting. According to the embodiment shown in FIGS. 11A to 11G, at the outset the seventh row is shifted leftward and then the fifth row, the third row, the first row, the sixth row, the fourth row and the second row are successively shifted leftward. Such shifting may be referred to an interlace scanning and such interlace scanning is very advantageous in preventing flickering of the display on the dot matrix display 13.

In order to achieve the display manner as shown in FIGS. 9A to 9G and 10, the first to seventh outputs of the ring counter 15 shown in FIG. 2 may be as such used as the first to seventh row selecting signals of the display 13. In such a case, it is necessary to reverse the count order in the ring counter 15 and the order of row designation of the character generator 7 by the counter as compared with the case of the previously described FIG. 2 embodiment. Furthermore, in order to achieve the interlace scanning display as shown in FIGS. 11A to 11G, the seventh output of the ring counter 15 is used as the second row selecting signal of the display 13, the sixth output of the ring counter is used as the seventh row selecting signal, the fifth output of the ring counter is used as the fifth row selecting signal, the fourth output of the ring counter is used as the third row selecting signal, the third output is used as the first row selecting signal, the second output is used as the sixth row selecting signal, and the first output is used as the fourth row selecting signal. Meanwhile, in this case it would be necessary to employ as the counter 47 a so-called binary counter for making advancement of "2" per each clock signal.

Another feature of the FIG. 2 embodiment resides in the display blank signal generating circuit 53. The display blank signal generating circuit 53 serves to detect by the counter 533 that the display signal of one character has transferred from the character generator 7 to the shift register 9, thereby to apply a display disabling signal of the logic zero to the shift register 9 by one bit. Accordingly, even if the bit number of one character of the character information obtained from the character generator 7 is changed, the circuit may be adapted thereto by simply changing the count-up number of the counter 533 and the display blank column can be provided with ease between the adjacent characters. Accordingly, the adjacent characters will not be overlapped on the dot matrix display 13 and hence legibility is much enhanced.

Figure 12:
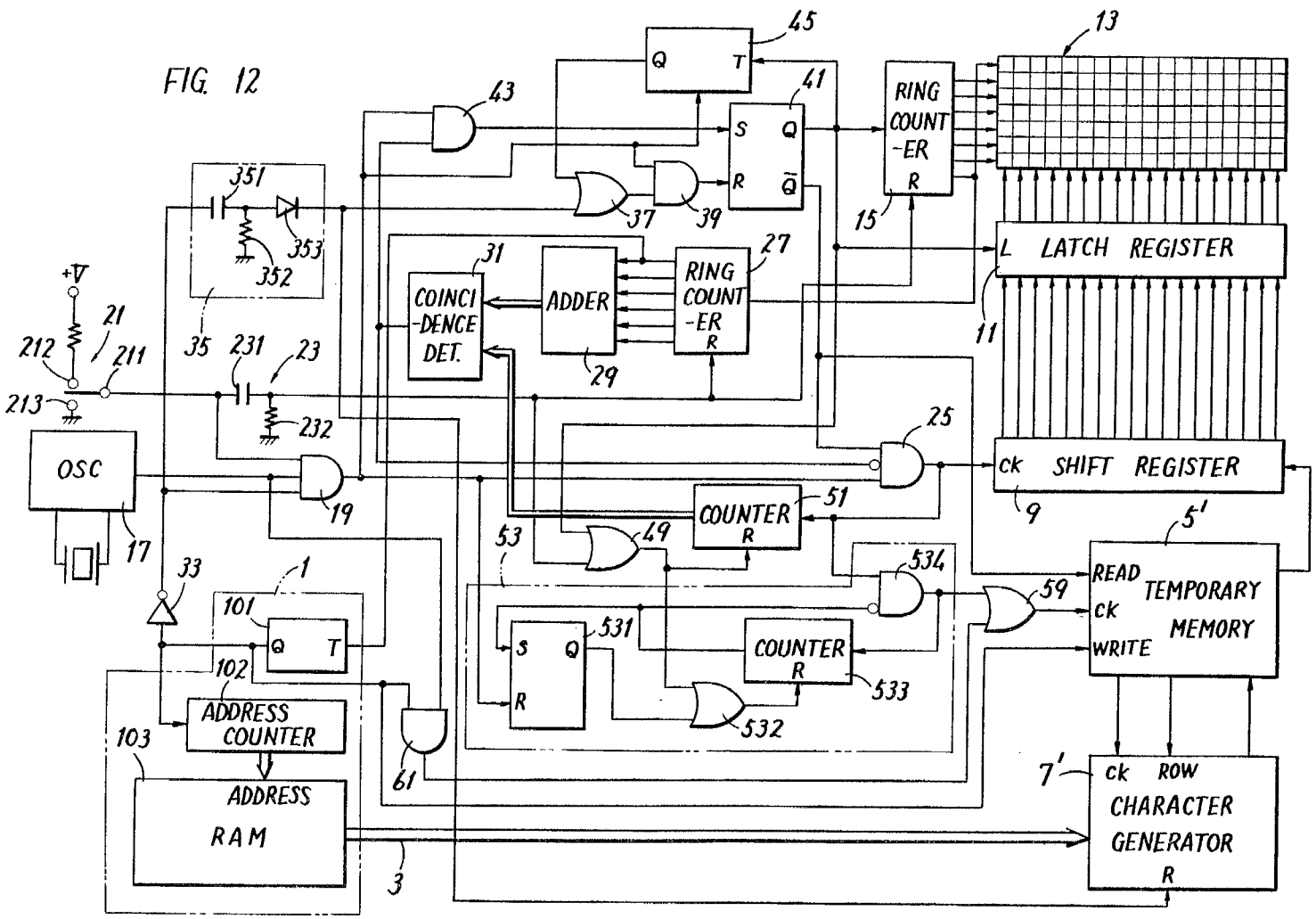
FIG. 12 is a block diagram showing another embodiment of the present invention.
Figure 13:
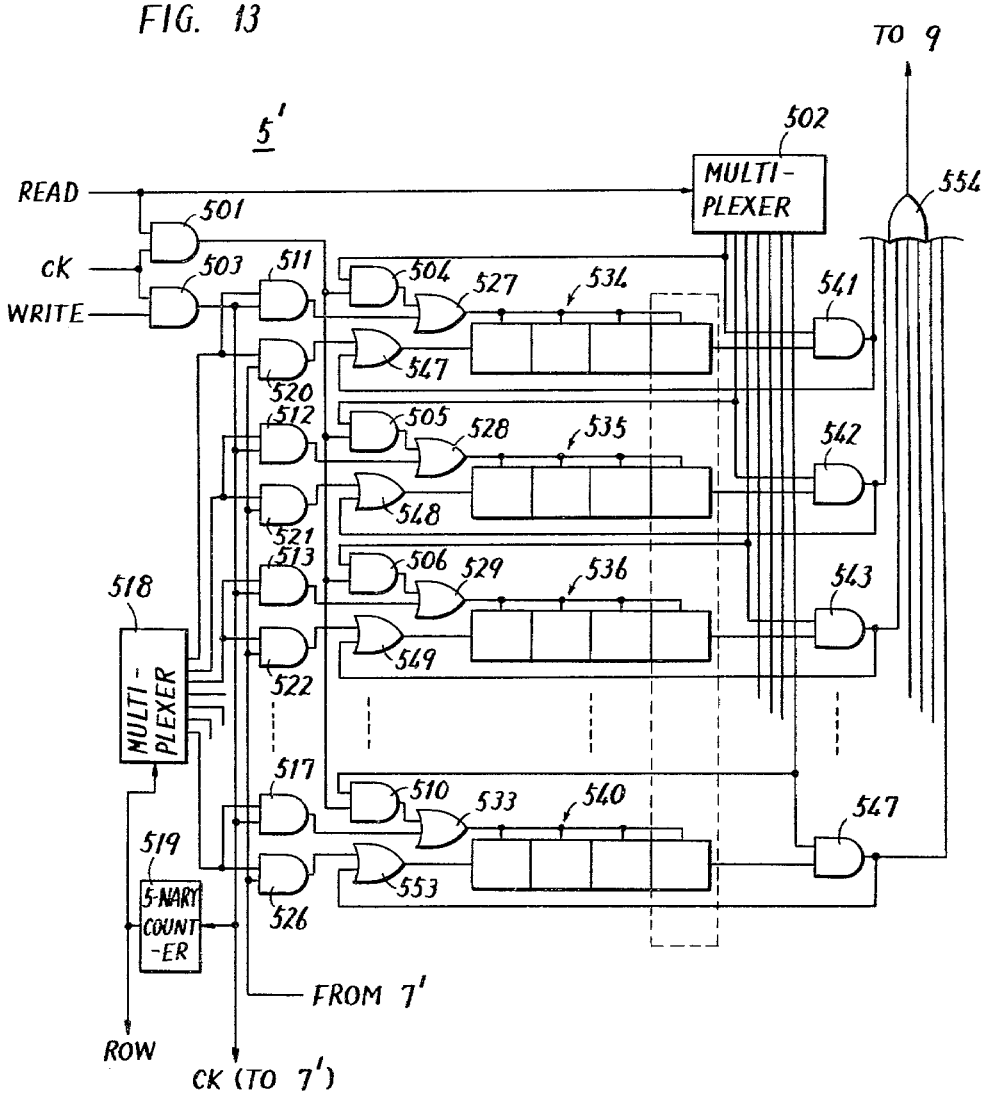
FIG. 13 is a block diagram showing in detail a temporary memory 5' for use in the FIG. 12 embodiment.

FIG. 12 is a block diagram showing another embodiment of the present invention. The embodiment shown is the same as the FIG. 2 embodiment, except for the following respects. More specifically, whereas the FIG. 2 embodiment was structured such that the character generator 7 is disposed subsequent to the temporary memory 5 and the display signal is transferred from the character generator to the shift register 9, the FIG. 12 embodiment is structured such that the data bus 3 from the memory circuit 1 is directly connected to the character generator 7'. Accordingly, the character generator 7' provides the display signal to the temporary memory 5' in a bit serial fashion, as described previously, responsive to the character information from the memory circuit, i.e. the character information providing means. The temporary memory 5' temporarily stores the display signal obtained from the character generator 7'. Upon receipt of the clock signal from the OR gate 59, the display signal of one row is transferred to the shift register in a bit serial fashion. The OR gate 59 is connected to receive the clock signal from the previously described AND gate 534 and the output of the two inputted AND gate 61. The two inputs of the two inputted AND gate 61 are connected to receive the clock signal obtained from the clock signal source, i.e. the reference oscillator 17, and the output of the one-shot circuit 101. Accordingly, when the first output from the ring counter 27 rises and the pulse signal is obtained from the one-shot circuit 101 for a predetermined time period, the clock signal is obtained from the AND gate 61 during that time period. On the other hand, the output of the one-shot circuit 101 is applied to the temporary memory 5' as the write enabling signal (WRITE). Accordingly, the temporary memory 5' is loaded with the display signal from the character generator 7' responsive to the clock signal obtained from the AND gate 61 and thus from the OR gate 59 during the high level output period of the one-shot circuit 101. Thereafter, the read enabling signal (READ) is applied from the output ($\overline{Q}$) of the flip-flop 41 to the temporary memory 5'. Accordingly, thereafter the temporary memory 5' reads out the previously loaded display signal responsive to the clock signal obtained from the AND gate 534 and thus from the OR gate 59 and is loaded in the shift register 9. Such temporary memory 5' may be structured as shown in FIG. 13. Meanwhile, in the case of the FIG. 12 embodiment, the random access memory 103 included in the memory circuit 1 continues transfer of the character information of the address as designated to the character generator 7', until the said address is changed by the address counter 102. Accordingly, the character generator 7' performs a conversion to the dot display signals in accordance with the character information and based on the character data (ASCII code).

FIG. 13 is a block diagram showing one example of the temporary memory 5'. As described previously, the temporary memory 5' is connected to receive the read enabling signal (READ) from the flip-flop 41, the clock signal (CK) from the OR gate 59, and the write enabling signal (WRITE) from the one-shot circuit 101. The read enabling signal (READ) is applied to one input of the AND gate 501 and is also applied to a multiplexer 502.

The write enabling signal (WRITE) is applied to an AND gate 503. The other inputs of the AND gates 501 and 503 are connected to receive the clock signal (CK). The output of the AND gate 501, i.e. the clock signal on the occasion of the reading operation, is applied to one input of each of 7 AND gates 504 to 510. The output of the AND gate 503, i.e. the clock signal on the occasion of the writing operation, is also applied to one input of each of 7 AND gates 511 to 517. The other input of each of these AND gates 511 to 517 is connected to individually receive the output from the multiplexer 518. The multiplexer 518 receives the clock signals, frequency divided by 5 by means of the counter 519, thereby successively provide individual outputs. The individual outputs from the multiplexer 518 are each applied to one input of each of 7 AND gates 520 to 526 and the other input of each of these AND gates 520 to 526 is connected to receive the bit serial display signal obtained from the character generator 7'. The respective outputs of these AND gates 504 to 510 and 511 to 517 are applied through the OR gates 527 to 533 to the respective bits of the storing areas (shift register) 534 to 540 as the reading or writing clock signals. In the embodiment shown, since the number of characters that can be stored in the temporary memory 5' has been determined as 4 characters, each of the storing areas 534' to 540 is of 20 ($=5\times4$) bits. The outputs from the AND gates 520 to 526 and the outputs of the AND gates 541 to 547 receiving the outputs of the storing areas 534 to 540 are both applied through the OR gates 547 to 553 to the inputs of the corresponding storing areas 534 to 540. The other inputs of the AND gates 541 to 547 are connected to receive the individual outputs from the multiplexer 502. The outputs of these AND gates 541 to 547 are applied through the OR gate 554 to the input of the shift register 9. During writing, the bit serial display signal obtained from the character generator 7' is distributed to the respective storing areas or the shift register 534 to 540 by means of the multiplexer 518. Conversely, during reading, the display signal of one character in the respective storing areas 534 to 540 is obtained through the respective AND gates 541 to 547 and the OR gate 554 in succession in a bit serial fashion by means of the multiplexer 502. More specifically, the respective storing regions 534 to 540 can store the dot display signals of one row. Accordingly, during writing, the multiplexer 518 selects in succession one of the storing regions 534 to 540 at each output of the counter 519, i.e. each time five clock signals (CK) are applied. Therefore, the dot display signals of the first to seventh rows obtained from the character generator 7' are stored in the respective storing regions 534 to 540. Then, during reading, the multiplexer 502 determines what row signals the dot display signals to be read at that time are, thereby to enable the read output of the storing regions corresponding to the above described row. For example, in the case where the dot display signals of the seventh row are outputted at the beginning, the multiplexer 502 enables the AND gates 510 and 547. Accordingly, the clock signal (CK) is applied from the AND gate 501 to the storing regions and the shift register 540 and the dot display signals of 20 bits of the seventh row are obtained from the shift register 540. Since at that time it is sufficient to apply the dot display signals of three characters to the shift register 9, the multiplexer 502 closes the AND gate 547 when the dot display signals of the final 5 bits, i.e. the characters of the fourth row are obtained. Likewise thereafter, in the case where the dot display singnals of the first row, for example, are transferred to the shift register 9, the multiplexer 502 enables the storing region 534.

Figures 14, 15:
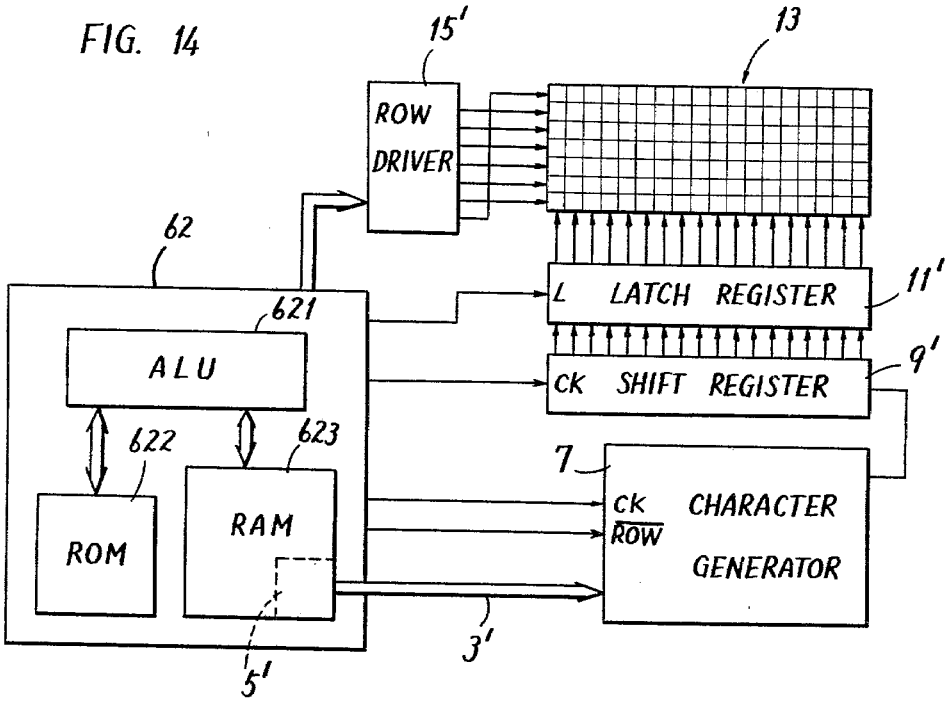
FIG. 14 is a block diagram showing a further embodiment of the present invention.
FIG. 15 is a view showing storing regions in a random access memory of the FIG. 14 embodiment.

FIG. 14 is a block diagram showing a further embodiment of the present invention. The FIG. 14 embodiment is different from the embodiments shown in FIGS. 2 and 12 in that the FIG. 14 embodiment employs a microprocessor 62. The microprocessor 62 comprises an arithmetic logic unit 621, and a read only memory 622 for storing an operation program of the arithmetic logic unit 621 and required constant, as well-known, and further comprises a random access memory 623. The random access memory 623 corresponds to the memory circuit 1 in the embodiments described in conjunction with FIGS. 2 and 12 and a temporary memory 5' may be implemented using a portion of the storing regions. At least store regions CNTA, CNTB, CNTC, and CNTn, CNTi, CNTj as shown in FIG. 15 are formed in the random access memory 623. The CNTA region corresponds to the counter 533 in the FIG. 2 embodiment, the CNTB region corresponds to the counter 51 in the FIG. 2 embodiment, and the CNTC region corresponds to the counter 47 in the FIG. 2 embodiment. The CNTn region corresponds to the ring counter 15 in the FIG. 2 embodiment, the CNTi region corresponds to a ring counter 57 in the FIG. 2 embodiment, and the CNTj region corresponds to the ring counter 27 in the FIG. 2 embodiment. The character data of such as the ASCII code is provided from the temporary memory 5' included in the random access memory 623 through the data bus to the character generator 7. Accordingly, the character generator 7 provides the display signal in a bit serial fashion to the shift register 9' responsive to the clock signal (CK) and the row designating signal ($\overline{\text{ROW}}$), in the previously described manner. The shift register 9' and the latch register 11' and the dot matrix display 13, and the row driver 15' may be the same as those shown in the FIG. 2 embodiment. Since the modified portions of the FIG. 14 embodiment were described above, the operation of the FIG. 14 embodiment will be described below with reference to the flow diagram shown in FIG. 16.

Upon turning on the power supply, the program executes the step S1. The step S1 is the initial reset step and the CNTA, CNTB, CNTC, and CNTn, CNTi, and CNTj regions are reset to an initial state. More specifically, the CNTA, CNTB and CNTC regions are cleared to be the numerical value 0 and the CNTn, CNTi and CNTj regions are set to the initial state, i.e. "1". At the following step S2, the character information being displayed is stored in a portion of the random access memory 623, i.e. in the temporary memory 5'. At the following step S3, the clock signal (CK) and the row designating signal ($\overline{\text{ROW}}$) are applied to the character generator 7', so that the data in the $(n-1)$th row of the characters designated by the CNTi region is transferred to the shift register 9'. At that time the clock signal (CK) is also applied to the shift register 9' as described previously. At the following step S4, it is determined whether the clock signal (CK) applied to the character generator 7 has become the number of k(a predetermined constant; the numerical value "17")+j. In the initial state, the above described "k+j" is the numerical value "18". Determination as YES at the step S4 means that all the dot display signals in one row which is common to the respective characters obtained from the character generator 7 have been transferred to the shift register 9'. At the beginning the determination at the step S4 is naturally NO and at the following step S5 it is determined whether transfer of the display signal of one character is completed in the light of the content in the CNTA region. If and when it is determined as NO at the step S5, then the program returns to the previous step S3, so that transfer of the display signal from the character generator 7 is continued. If and when it is determined as YES at the step S5, then in order to load the display blank signal in the shift register 9', the transferring block signal (CK) is blocked from being applied to the character generator 7. At the same time, in order to load the display blank signal of one bit in the shift register 9', one clock signal (CK) is applied to the shift register 9' at the step S6. At the following step S7 the numerical value "1" is added to the CNTi region. Accordingly, the character generator 7 transfer the following character information to the shift register 9' in the same manner as described previously. Accordingly, when the display signals of the three characters and the display blank signals between these characters are all loaded in the shift register 9', determination at the step S4 becomes YES. Accordingly, at the following step S8 the latch enabling signal L is applied to the latch register 11'. Accordingly, the latch register 11' is loaded with the display signal which has been loaded in the shift register 9'. At the following step S9, the CNTi region is turned to the numerical value "1" and the numerical value "1" is subtracted from the content in the CNT region. At the beginning the content in the CNT region is "1". Accordingly, it has been structued such that "1-1" may be "7". Therefore, at the following step S10, the seventh row display is made as shown in FIG. 3A on the dot matrix display 13 by means of the row driver 15' and the latch register 11'. Then at the following step S11, it is determined whether the content in the CNTn region is "1". More specifically, it is determined whether all display was made up to the first row of the dot matrix display 13. In the case where determination at the step S11 is NO, the program returns to the previous step S3. If and when conversely the decision at the step S11 is YES, then at the following step S12 the numerical value "1" is added to the content in the CNTj region. The purpose of thus adding the numerical value "1" to the CNTj region is to make the leftward shifting operation by one column in the next display. Then at the following step S13 the content in the CNTB region and the content in the CNTj region are compared, to thereby determine whether both coincide with each other. In the case where it is determined as NO at the step S13, then the program returns to the step S13. Conversely, if and when it is determined as YES at the step S13, then at the following step S14 it is determined whether display of all the characters being displayed is completed. If and when it is determined as NO at the step S14, then the program returns to the previous step S2 and, conversely, if and when it is determined as YES at the step S14, the scrolling display program is completed. The operation of the FIG. 14 embodiment would be more readily appreciated by recalling the previously described operation of the FIG. 2 embodiment. In the case of the FIG. 12 embodiment, the character generator 7 may be incorporated in the read only memory 622 of the microprocessor 62.

Meanwhile, the previously described FIG. 2 embodiment was described such that the character generator 7 comprised a parallel/serial converter. However, the character generator 7 may not comprise a parallel/-serial converter. In such a case, a shift register and so on adapted to receive a bit parallel output of the character generator 7 is provided. Accordingly, the shift register 11 shown in FIG. 2 may be shared with the same. Thus, where the character generator 7 does not comprise a parallel/serial converter, for the purpose of providing the display blank signal, the sixth bit input is connected to a ground and the seventh bit input is connected to the reset.

Meanwhile, the above described embodiment was adapted such that the memory circuit, the random access memory and other memory apparatus were used as a character information providing means. However, a keyboard and any other character information entry means of a well-known type may be used for that purpose. For the purpose of the present invention, such character information entry means may comprise such data bus 3 or 3' only as shown in FIGS. 2, 12 and 14. Furthermore, such character information may be directly received from a terminal unit of a telephone line.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dot matrix display apparatus, comprising:

dot matrix display means capable of displaying a plurality (j) of characters, each character being displayed by an arrangement of dots in a plurality (m) of columns by a plurality (n) of rows, character information providing means for providing character information concerning characters to be displayed, dot display signal generating means responsive to said character information obtained from said character information providing means for generating dot display signals of said dots in said plurality (m) of columns by said plurality (n) of rows for each character of a plurality (i) of characters, where i is a natural number and $i>j$, register means having storing regions of substantially the same number as the total column number of said dot matrix display means for storing dot display signals for driving the corresponding columns of said dot matrix display means, loading means for loading in said register means in a row sequence the dot display signals of a common row out of said dot display signals as regards the respective characters obtained from said display signal generating means, row driving means for driving said dot matrix display means in said row sequence, first detecting means for detecting that said loading means has loaded at least one time the dot display signals of all said plurality (n) of rows in said register means, column shifting means responsive to the output of said first detecting means for shifting for each row the columns of said dot display signals being loaded in said register means by means of said loading means, and second detecting means for detecting that said shifting takes place for all said rows by said plurality (m) of columns by means of said column shifting means, said character information providing means being responsive to the output of said second detecting means for providing subsequent character information concerning characters to be subsequently displayed to said display signal generating means.

2. A dot matrix display apparatus in accordance with claim 1, wherein said loading means comprises display blank signal inserting means for inserting a display blank signal corresponding to at least one column in said dot matrix display means between the dot display signals of the adjacent characters being loaded in said register means.

3. A dot matrix display apparatus in accordance with claim 2, wherein said display blank signal inserting means is included in said dot display signal generating means for inserting said display blank signal between the dot display signals of the adjacent characters before said dot display signals are outputted from said dot display signal generating means.

4. A dot matrix display apparatus in accordance with claim 2, wherein said display blank signal inserting means comprises display blank signal loading means for loading said display blank signal in a subsequent region of said register means each time said dot display signals of one character obtained from said dot display signal generating means are loaded in said register means.

5. A dot matrix display apparatus in accordance with claim 4, wherein said display blank signal inserting means comprises one character detecting means for detecting that said dot display signals of said one character obtained from said dot display signal generating means are loaded in said register means, and predetermined logical signal loading means responsive to the output of said one character detecting means for loading a predetermined logical signal in said subsequent region as said display blank signal.

6. A dot matrix display apparatus in accordance with claim 5, which further comprises clock source means for providing a clock signal, and wherein said register means comprises a shift register responsive to said clock signal from said clock source means for making a shifting operation, said loading means comprises load enabling means responsive to said clock signal for enabling the loading of said dot display signals in said shift register, and said predetermined logical signal loading means comprises clock signal stopping means responsive to the output of said one character detecting means for stopping said clock signal from being applied from said clock source means to said loading means.

7. A dot matrix display apparatus in accordance with claim 1, wherein said dot display signal generating means comprises temporary memory means for temporarily storing said character information of said plurality (i) of characters obtained from said character information providing means, and display signal converting means responsive to said character information stored in said temporary memory means for converting said character information of each said character into said dot display signals of said dots in said plurality (m) of columns by said plurality (n) of rows.

8. A dot matrix display apparatus in accordance with claim 1, wherein said dot display signal generating means comprises display signal converting means for converting said character information of each said character obtained from said character information providing means into said dot display signals of said dots in said plurality (m) of columns of said plurality (n) of rows, and temporary memory means for temporarily storing said dot display signals of said plurality (i) of characters obtained from said display signal converting means.

9. A dot matrix display apparatus in accordance with claims 7 or 8, wherein said display signal converting means comprises a character generator.

10. A dot matrix display apparatus in accordance with claim 1, wherein said column shifting means is adapted to shift said columns of said dot display signals from the lower row in succession toward the upper row on said dot matrix display means.

11. A dot matrix display apparatus in accordance with claim 1, wherein said column shifting means is adapted to shift said columns of said dot display signals from the upper row in succession toward the lower row on said dot matrix display apparatus.

12. A dot matrix display apparatus in accordance with claim 1, 10 or 11, wherein said column shifting means is adapted to shift said columns of said dot display signals in succession of row spaced more than one row at the least on said dot matrix display means.

13. A dot matrix display apparatus in accordance with claims 10 or 11, wherein said register means comprises a shift register, and said column shifting means comprises shift out means for shifting out said dot display signals in the regions corresponding to the number of columns to be shifted from said shift register.

14. A dot matrix display apparatus in accordance with claim 13, which further comprises shift clock providing means for providing a shift clock signal to said shift register, and wherein said shift out means comprises shift clock number changing means responsive to the output of said first detecting means for changing the number of said shift clock signals to be applied to said shift register from said shift clock providing means.

15. A dot matrix display apparatus in accordance with claim 14, wherein said shift clock number changing means comprises first counter means for counting the output of said first detecting means, adder means for adding a predetermined number to said count value in said first counter means, second counter means for counting said shift clock signals being applied from said shift clock providing means to said shift register, and stopping means for stopping said shift clock signals from being applied from said shift clock providing means to said shift register when the sum of said adder means becomes equal to the count value in said second counter means.

16. A dot matrix display apparatus in accordance with claim 6, wherein said register means comprises latch register means having regions of the same number as the number of regions in said shift register for latching said dot display signals loaded in said shift register, and said dot matrix dislay means is driven such that the corresponding columns are displayed by the dot display signals of the respective regions in said latch register means.

17. A dot matrix display apparatus in accordance with claim 1, wherein said character information providing means comprises memory means for storing said character information of said characters being displayed.

18. A dot matrix display apparatus in accordance with claim 1, wherein said character information providing means comprises a keyboard.

19. A dot matrix display apparatus in accordance with claim 1, which further comprises character information generating means being externally provided, and wherein said character information providing means comprises an input line adapted for receiving said character information from said character information generating means externally provided.

20. A dot matrix display apparatus in accordance with claim 19, wherein said input line comprises a data bus.

21. A dot matrix display apparatus in accordance with claim 1, wherein said dot matrix display means comprises an arrangement of light-emitting diodes disposed in said plurality (m) of columns by said plurality (n) of rows for each said character.

22. A dot matrix display apparatus in accordance with claim 1 or 21, wherein said dot matrix display means comprises an arrangement of light-emitting diodes disposed in a plurality ($m \times j + j$) of columns by said plurality (n) of rows.

23. A dot matrix display apparatus in accordance with claim 22, wherein said plurality (j) is selected to be $1 + k/m$, where k is a natural number.

24. A dot matrix display apparatus in accordance with claim 1, which further comprises clock source means for providing a clock signal, and wherein said register means comprises a shift register responsive to said clock signal from said clock source means for making a shift operation, and said loading means comprises load enabling means responsive to said clock signal for enabling the loading of said dot display signals in said shift register.

25. A dot matrix display apparatus, comprising:

dot matrix display means capable of displaying a plurality (j) of characters, each character being displayed by an arrangement of dots in a plurality (m) of columns by a plurality (n) of rows, dot display signal generating means for generating dot display signals of said dots in said plurality (m) of columns by said plurality (n) of rows for each character of a plurality (i) of characters, where i is a natural number and $i \geqq j$, register means having storing regions of substantially the same number as the total column number of said dot matrix display means for storing dot display signals for driving the corresponding columns of said dot matrix display means, loading means for loading in said register means in a row sequence the dot display signals of a common row out of said dot display signals as regards the respective characters obtained from said dot display signal generating means, row driving means for driving said dot matrix display means in said row sequence, detecting means for detecting that said loading means has loaded at least one time the dot display signals of all of said plurality (n) of rows in said register means, and column shift means responsive to the output of said detecting means for shifting for each row the columns of said dot display signals to be loaded in said register means by means of said loading means, said column shifting means being adapted such that, when the characters being displayed on said dot matrix display means appear to move in a first direction when said shifting takes place by means of said column shifting means, said shifting may take place in succession from a predetermined first row to a second row in association with said first direction.

26. A dot matrix display apparatus in accordance with claim 25, wherein said first direction is the leftward direction, said first row is a lower row in said dot matrix display means, and said second row is an upper row in said dot matrix display means.

27. A dot matrix display display apparatus in accordance with claim 25, wherein said first direction is the rightward direction, said first row is an upper row on said dot matrix display means, and said second row is a lower row in said dot matrix display means.

28. A dot matrix display apparatus in accordance with claim 25, 26 or 27, wherein said register means comprises a shift register, and said column shifting means comprises shift out means for shifting out said dot display signals in the regions corresponding to the number of columns to be shifted from said shift register.

29. A dot matrix display apparatus in accordance with claim 28, which further comprises shift clock providing means for providing a shift clock signal to said shift register, and wherein said shift out means comprises shift clock number changing means responsive to the output of said first detecting means for changing the number of said shift clock signals to be applied to said shift register from said shift clock providing means.

30. A dot matrix display apparatus in accordance with claim 29, wherein said shift clock number changing means comprises first counter means for counting the output of said first detecting means, adder means for adding a predetermined number to said count value in said first counter means, second counter means for counting said shift clock signals being applied from said shift clock providing means to said shift register, and stopping means for stopping said shift clock signals from being applied from said shift clock providing means to said shift register when the sum of said adder means becomes equal to the count value in said second counter means.

31. A dot matrix display apparatus in accordance with claim 25, wherein said dot matrix display means comprises an arrangement of light-emitting diodes disposed in said plurality (m) of columns by said plurality (n) of rows for each said character.

32. A dot matrix display apparatus in accordance with claim 29, wherein said dot matrix display means comprises an arrangement of light-emitting diodes disposed in a plurality ($m \times j + j$) columns by said plurality (n) of rows.

33. A dot matrix display apparatus in accordance with claim 32, wherein said plurality (j) is selected to be $1 + k/m$, where k is a natural number.

34. A dot matrix display apparatus in accordance with claims 1, 10 or 11, wherein said column shifting means is adapted to shift said columns of said dot display signals in succession of row spaced more than one row at the least on said dot matrix display means, said register means comprises a shift register, and said column shifting means comprises shift out means for shifting out said dot display signals in the regions corresponding to the number of columns to be shifted from said shift register.

35. A dot matrix display apparatus in accordance with claim 34, which further comprises shift clock providing means for providing a shift clock signal to said shift register, and wherein said shift out means comprises shift clock number changing means responsive to the output of said first detecting means for changing the number of said shift clock signals to be applied to said shift register from said shift clock providing means.

36. A dot matrix display apparatus in accordance with claim 35, wherein said shift clock number changing means comprises first counter means for counting the output of said first detecting means, adder means for adding a predetermined number to said count value in said first counter means, second counter means for counting said shift clock signals being applied from said shift clock providing means to said shift register, and stopping means for stopping said shift clock signals from being applied from said shift clock providing means to said shift register when the sum of said adder means becomes equal to the count value in said second counter means.

37. A dot matrix display apparatus in accordance with claim 34, wherein said register means comprises latch register means having regions of the same number as the number of regions in said shift register for latching said dot display signals loaded in said shift register, and said dot matrix display means is driven such that the corresponding columns are displayed by the dot display signals of the respective regions in said latch register means.

38. A dot matrix display apparatus in accordance with claims 10 or 11, wherein said register means comprises a shift register, said column shifting means comprises shift out means for shifting out said dot display signals in the regions corresponding to the number of columns to be shifted from said shift register, said register means comprises latch register means having regions of the same number as the number of regions in said shift register for latching said dot display signals loaded in said shift register, and said dot matrix display means is driven such that the corresponding columns are displayed by the dot display signals of the respective regions in said latch register means.

* * * * *